United States Patent [19]

Ticktin et al.

[11] 4,159,115

[45] Jun. 26, 1979

[54] HANDLE GRIP

[75] Inventors: Saul Ticktin, Pointe Claire; Daniel Mardinger, Dorval, both of Canada

[73] Assignee: Ticktin & Mardinger Ltd., Pointe Claire-Dorval, Canada

[21] Appl. No.: 874,489

[22] Filed: Feb. 2, 1978

[30] Foreign Application Priority Data

Feb. 14, 1977 [CA] Canada ..... 271675

[51] Int. Cl.[2] ..... A63B 49/08

[52] U.S. Cl. ..... 273/75; 273/81.5

[58] Field of Search ..... 273/67 R, 67 DA, 68, 273/72 R, 72 A, 73 J, 75, 81 R, 81.4–81.6, 165, 166; 43/23; 15/143 R, 159 R; 16/110 R, 116 R, 117, DIG. 12; 145/61 R, 61 C; 74/551.9, 558, 558.5; 128/DIG. 15

[56] References Cited

U.S. PATENT DOCUMENTS

| | | | |
|---|---|---|---|
| 1,447,989 | 3/1923 | Kinsman | 273/81 R |
| 2,002,535 | 5/1935 | Gagnier | 273/81 R |
| 2,309,933 | 2/1943 | Churchill | 273/81.5 X |
| 2,776,582 | 1/1957 | Blades | 74/558.5 X |
| 3,368,811 | 2/1968 | Finney | 273/166 X |
| 3,397,891 | 8/1968 | Koch | 273/165 X |
| 3,508,280 | 4/1970 | Osborn | 273/166 X |
| 3,614,100 | 10/1971 | Spitz | 273/75 |
| 3,845,954 | 11/1954 | Case | 273/81.5 X |
| 3,895,797 | 7/1975 | Moore | 46/DIG. 1 |
| 4,012,039 | 3/1977 | Yerke | 273/81 R X |

FOREIGN PATENT DOCUMENTS

| | | | |
|---|---|---|---|
| 566538 | 2/1924 | France | 273/75 |
| 697656 | 9/1953 | United Kingdom | 273/81 R |

OTHER PUBLICATIONS

"Golf Digest"; Apr. 1976; p. 137.

*Primary Examiner*—Richard J. Apley

*Attorney, Agent, or Firm*—Swabey, Mitchell, Houle, Marcoux & Sher

[57] ABSTRACT

A handle for a racket or the like having a first spirally wound strip having flexible resilient stubble members sticking out from the strip, and a second removable, spirally wound, terry-cloth strip anchored to the first strip for providing a moisture-absorbing, firm, handle grip.

9 Claims, 2 Drawing Figures

HANDLE GRIP

BACKGROUND OF THE INVENTION

1. Field of the Invention

The present invention relates to a handle grip for use with sports handles and the like, and more particularly to a removable absorbent-type handle grip.

2. Description of the Prior Art

There has been some development heretofore to provide a replaceable grip for a handle on athletic apparatus which can be subjected to considerable moisture from perspiration, but which will still provide a comfortable grip without interfering with the natural feel of the player on the handle.

Such devices are illustrated, for instance, in U.S. Pat. No. 3,614,100, issued Oct. 19, 1971, H. D. Spitz, inventor, which shows an inner elastic tube and an outer tube of terry-cloth connected to the inner tube and having a split longitudinally of the sleeve to allow the elastic inner sleeve to expand when fitted over a handle.

U.S. Pat. No. 3,845,954, issued Nov. 5, 1974, G. S. Case, inventor, illustrates a handle grip to which an adhesive tape having an exposed, pressure-sensitive, glutinous composition is spirally wound and fixed to the grip and is adapted to retain a spirally wound terry-cloth strip.

In both of these cases, the terry-cloth strip provides suitable absorbent material for absorbing the natural perspiration of a player's hand but is thin enough that the player will not feel an undue change in the feel of the handle grip. Accordingly, the handle grips in accordance with these two patents provide the necessary requirement for a comfortable handle grip which is also absorbent to moisture. It is not certain, however, that the Spitz handle grip will resist torsional forces on the handle and thereby require the player to use up energy by having to increase the force of his grasp on the handle to prevent it from rotating. In the Case patent, the anchoring of the terry-cloth strip to the handle is improved, but each time a terry-cloth strip is removed and replaced, the pressure-sensitive, glutinous composition on the base strip fixed to the grip is deteriorated. Accordingly, after a few changes of the terry-cloth strip, the handle grip is no longer as efficient and is no longer as resistant to torsional forces.

SUMMARY OF THE INVENTION

It is an aim of the present invention to provide a handle grip of the type described, that is, including an absorbent strip of woven material removably held to a handle grip but which will not have the disadvantages of the prior art handle grips as described above.

A construction in accordance with the present invention includes a handle grip for a sports apparatus handle, a first sleeve fixed to the handle and including upstanding stubble made up of individual flexible resilient monofilament members, an elongated narrow strip of soft absorbent material adapted to be spirally wound on the sleeve, and means for fastening the end of the spirally wound woven material near one end of the sleeve.

In a more specific embodiment of the present invention, the sleeve fixed to the handle grip is made up of a narrow, spirally wound, overlapping, woven strip with an adhesive on one side thereof adapted to be adhesively fixed to the handle, and the absorbent strip is a woven terry-cloth material.

The woven terry-cloth strip may be provided with a lock stitch on either edge thereof to prevent unravelling and also to improve gripping by providing a relatively harder ridge so as to locate one's hand on the grip.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
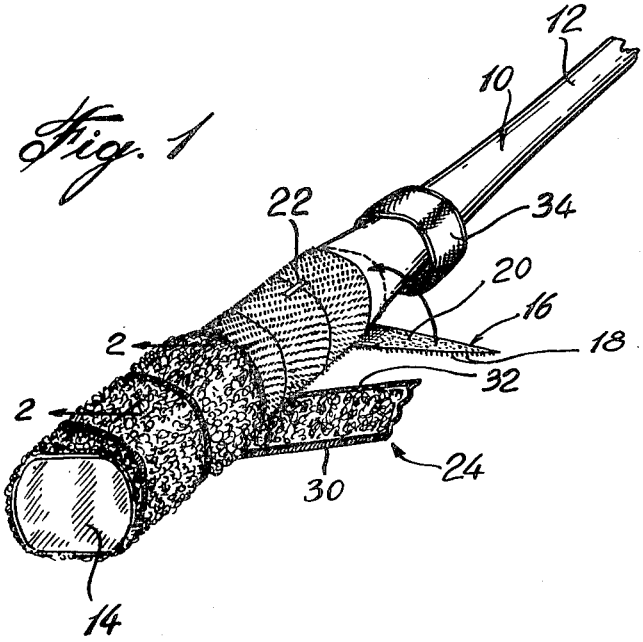
FIG. 1 is a perspective view of a typical sports apparatus handle showing the parts of the handle grip in a partly unwound condition.

Referring now to the drawings, there is shown a typical racket 10 having a stem 12 and an enlarged handle 14. A first woven strip 16 with nylon stubble 18 on one side, and a pressure-sensitive adhesive backing 20 is spirally wound on the handle 14 as shown in FIG. 1. In addition to retaining the so-called anchor strip 16 by adhesive means, other fastening means, such as a metal staple 22, can be used to ensure that the strip 16 will not accidentally unravel from the handle.

Figure 2:
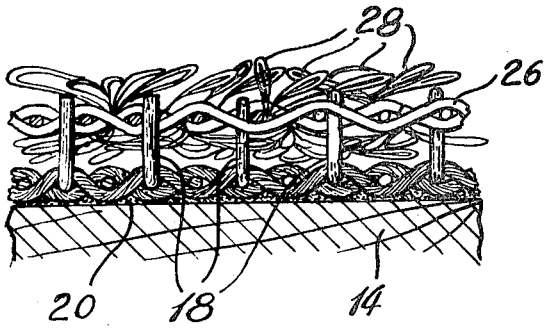
FIG. 2 is a vertical cross-section taken along line 2—2 of FIG. 1 and is an enlarged view.

Referring to FIG. 2, the stubble 18 is shown and can be made in accordance with a "Velcro" type process for fabricating fastener fabrics, except that hooks are not formed with the nylon stubble, but the warp loops are cut on both stems to leave simply vertical stems protruding upwardly from the woven base fabric. The stems could be made from other material besides nylon as long as they have similar properties, that is, of being flexible and resilient.

In the present embodiment, a terry-cloth woven strip 24 is used as the removable absorbent cover. The strip 24 preferably has a woven base 26 and loops 28. The terry-cloth strip 24 also has edges finished with lock stitches 30 and 32. In order to retain a proper feel, it has been found that a preferred terry-cloth would be of between 10 oz. and 15 oz. per square yard. Other soft materials, such as leather or other woven materials, have been found to be useful as the absorbent strip 24.

The terry-cloth strip 24 is spirally wound and normally starts from the bottom of the handle with the edges overlapping, as shown in FIG. 1, onto the anchor strip 16. As the end of the terry-cloth strip 24 is wound, an elastic loop 34 which is normally placed on the stem before applying the terry strip, is placed over the end of the terry-cloth strip 24 to hold it there and prevent the terry-cloth strip from unwinding. The loop 34 can be an elastic band having exposed rubber ribs such as is used in waistbands.

As shown in FIG. 2, the stubble 18 in practice extends upwardly between the warps and wefts of the woven base 26 of the terry-cloth strip 24 to hold it against torsional forces. It has been found that the type of anchor fabric used with the flexible resilient stubble 18 does not lose its hold no matter how many times the absorbent terry-cloth strip 24 is removed and replaced. It has also been found that the terry-cloth strip 24 sustains minimum damage, it any at all, in its engagement with the anchor fabric 16.

The diameter of the grip can be varied slightly by winding the strip 24 differently, that is, by forming a spiral having a smaller or greater angle of departure from a plane taken at right angles to the longitudinal axis of the spiral.

The terry-cloth strip 24 can preferably be woven with the insertion of elastic warp yarns so as to make the strip stretchable, thus enhancing its application and retention on the handle 14.

We claim:

1. A handle grip assembly for sports apparatus including a sheet member securely fixed to a handle of a piece of sports apparatus, said sheet member including stubble elements projecting from one side thereof away from the outer surface of said handle, said stubble elements comprising individual, spaced apart, straight, flexible mono-filaments, the roots of each filament being anchored in said sheet member and extending outwardly away from said sheet member;

a strip of soft, absorbent, porous material having portions receiving the mono-filaments elements therein, said strip of absorbent material being wound about said sheet member with the stubble elements projecting into said portions and restraining said strip from shifting movement on said handle while the apparatus is being used for the purpose intended; and means for fastening at least a free end of the strip onto said handle in wound relation on said first sheet member to prevent unwinding of said strip.

2. A handle grip as defined in claim 1 wherein the sheet member includes a pressure sensitive adhesive on one side thereof adhesively fixed to the handle.

3. A handle grip according to claim 2 wherein the woven absorbent material is a terry-cloth having finished marginal edges.

4. A handle grip as defined in claim 1 wherein the elements are a portion of a woven fabric.

5. A handle grip as defined in claim 2 wherein the absorbent material is woven and includes elastic yarns.

6. A handle grip as defined in claim 5 wherein the means for retaining the free end of the strip is an elastic band.

7. A handle grip as defined in claim 1 wherein the strip of soft absorbent material has a lock stitch on opposite edges.

8. A handle grip as defined in claim 1 wherein the absorbent strip is a handle-leather.

9. A handle grip as defined in claim 1 wherein the absorbent material is a terry-cloth between 10 oz. and 15 oz. per square yard.

* * * * *